United States Patent [19]

Pollert

[11] Patent Number: 4,710,302

[45] Date of Patent: Dec. 1, 1987

[54] PROCESS FOR THE SEPARATION OF THE WATER RESULTING DURING THE COKING PROCESS INTO A SMALL SALT-RICH FRACTION AND A LARGE SALT-POOR FRACTION

[75] Inventor: Georg Pollert, Essen, Fed. Rep. of Germany

[73] Assignee: Bergwerksverband GmbH, Essen-Kray, Fed. Rep. of Germany

[21] Appl. No.: 833,388

[22] PCT Filed: Jun. 19, 1985

[86] PCT No.: PCT/EP85/00298

§ 371 Date: Feb. 14, 1986

§ 102(e) Date: Feb. 14, 1986

[87] PCT Pub. No.: WO86/00332

PCT Pub. Date: Jan. 16, 1986

[30] Foreign Application Priority Data

Jun. 28, 1984 [DE] Fed. Rep. of Germany ..... 3423798

[51] Int. Cl.[4] ..... C02F 5/00; C10K 1/00

[52] U.S. Cl. ..... 210/696; 210/774; 210/805; 55/9

[58] Field of Search ..... 210/748, 696, 773, 774, 210/805, 806; 55/9, 11, 80

[56] References Cited

U.S. PATENT DOCUMENTS

| | | | |
|---|---|---|---|
| 4,370,236 | 1/1983 | Ferguson | 210/748 X |
| 4,382,866 | 5/1983 | Johnson | 210/748 |
| 4,416,754 | 11/1983 | Merchant et al. | 210/748 X |

FOREIGN PATENT DOCUMENTS

| | | |
|---|---|---|
| 0050579 | 4/1982 | European Pat. Off. . |
| 2542055 | 3/1977 | Fed. Rep. of Germany . |
| 2088406 | 6/1982 | United Kingdom . |

*Primary Examiner*—Tom Wyse

*Attorney, Agent, or Firm*—Karl F. Ross; Herbert Dubno

[57] ABSTRACT

In a process for the separation of the water resulting during coking in a small salt-rich fraction and a large salt-poor fraction, the crude gas, after being cooled in the condenser is directed through an electrofilter, prior to entering the primary coolers. Thereby, the condensate resulting from the condenser and the discharge of the electrofilter are united in the tar separator, while the condensate of the primary coolers is partially returned to the condenser circuit and the balance is the salt-poor fraction. Oppositely thereto, the aqueous phase of the tar separator is further treated as the salt-rich fraction. After exiting the electrofilter, the crude gas can be fractionally cooled also in several primary coolers.

2 Claims, 1 Drawing Figure

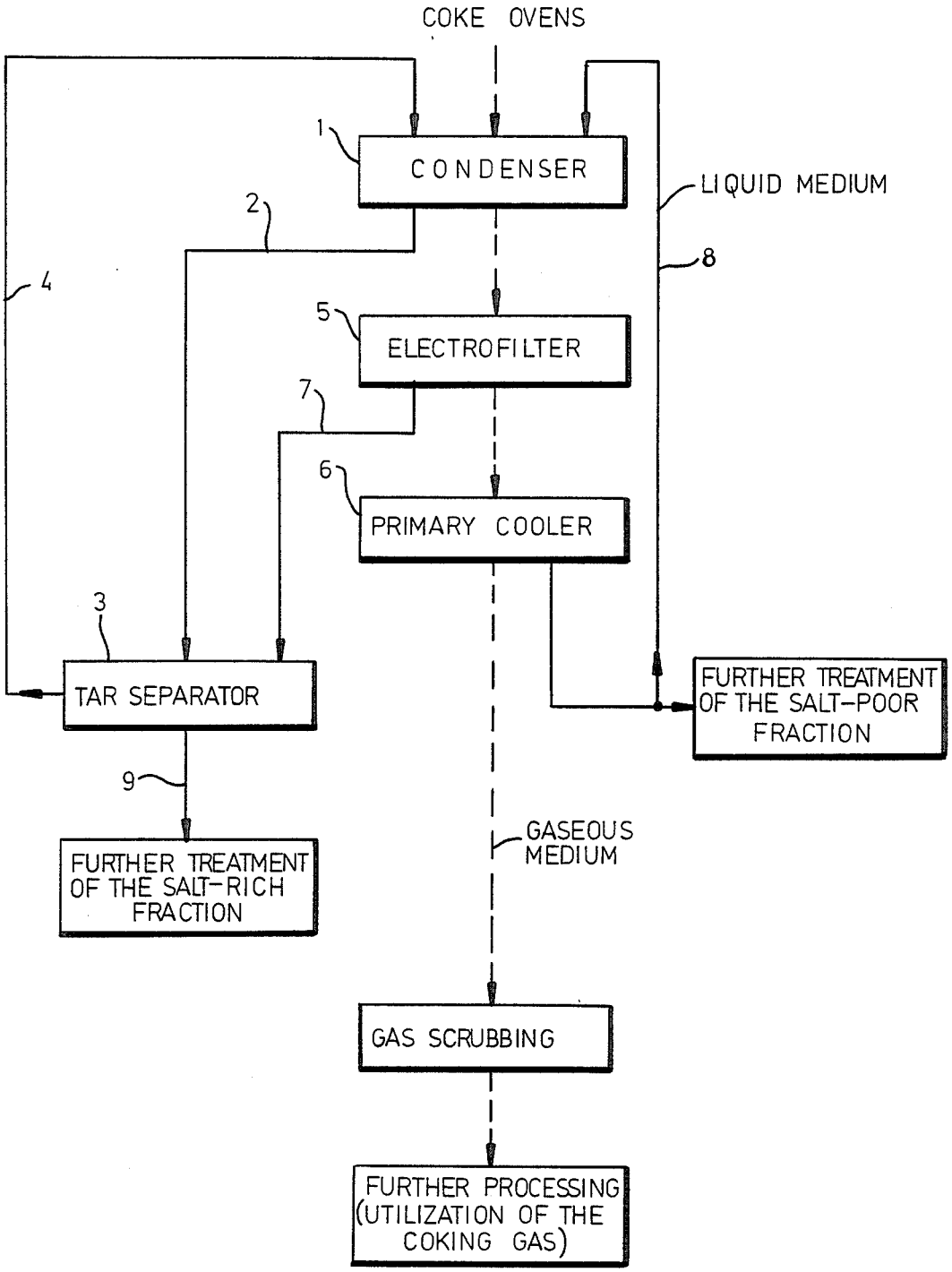
COKE OVENS
1
CONDENSER
LIQUID MEDIUM
2
8
4
5
ELECTROFILTER
7
6
PRIMARY COOLER
3
TAR SEPARATOR
FURTHER TREATMENT OF THE SALT-POOR FRACTION
9
FURTHER TREATMENT OF THE SALT-RICH FRACTION
GASEOUS MEDIUM
GAS SCRUBBING
FURTHER PROCESSING (UTILIZATION OF THE COKING GAS)

PROCESS FOR THE SEPARATION OF THE WATER RESULTING DURING THE COKING PROCESS INTO A SMALL SALT-RICH FRACTION AND A LARGE SALT-POOR FRACTION

FIELD OF THE INVENTION

The invention relates to a process for the separation of the coal water resulting from a coking process into a small salt-rich fraction and a large salt-poor fraction and, more particularly, to a process for treating a hot gas from a coking process which contains water vapor in addition to salts or salt-forming components and tars.

BACKGROUND OF THE INVENTION

During the coking of coal, normally 140 l of coal water per ton of coal can result, approximately 100 l thereof coming from the initial moisture content of the coal and approximately 40 l resulting from the coking process itself. During coking, in addition to the volatile noxious substances like $NH_3$, $H_2S$ and HCN, fixed salts, mainly $NH_4Cl$ can be produced, can be dissolved in the gas condensate, and cannot be removed again by desorptive processes. Therefore, up to now it has not been possible to reuse as service water the gas condensate resulting from such cleaning steps as dephenolizing or stripping in the still, because its salt content remains high even after the release of the fixed ammonia with lime or alkali.

Normally, in a coking plant, the hot gas at about 800° C. coming from the rising main is cooled in the condenser down to the dew point of about 80° C. by the gas condensates guided in closed circuit. Thus only a part of the fixed salts reach the closed-circuit condensate partially; the rest goes together with the gas into the cooler condensate, so that the separation of the gas condensate into a salt-containing and a salt-free fraction cannot take place.

However, a process for the production from a condensate free of fixed salts is known, wherein the crude gas is scrubbed between the condenser and the primary cooler, in order to eliminate the fixed salts from the gas (U.S. Pat. No. 1,747,616). An examination of this process dating from the year 1922 shows that this process has not been a success, because the fixed salts are present in the form of aerosols, which can not be eliminated through scrubbing.

OBJECT OF THE INVENTION

It is therefore the object of this invention to remove from the gas the fixed salts not eliminated at the condenser nozzles, prior to the gas condensation in the primary cooler, so that the major part of the water resulting from the coking process can be salt-free and returned, after further cleaning steps, into the system of the coking plant as service water.

SUMMARY OF THE INVENTION

This object is attained in accordance with the invention in a process in which a crude gas is cooled in a condenser and is then passed through an electrofilter prior to entering the primary cooler or coolers for further cooling. The condensate resulting from the condenser and the discharge from the electrofilter are united in the tar separator. The condensate from the primary cooler or coolers is partially returned to the condenser circuit while the balance is subjected to further treatment as a salt-poor fraction. The aqueous phase of the tar separator is partially subjected to further treatment as a salt-rich fraction.

By passing the crude gases of the coking plant through an electrofilter, between the condenser and primary coolers, the fixed salts are eliminated in proportion of over 96% from the steam-saturated crude gas.

BRIEF DESCRIPTION OF THE DRAWING

The invention is described in greater detail below with reference to the drawing. The sole FIGURE is a flow diagram which represents schematically the gas scrubbing operation downstream of the coking furnaces.

SPECIFIC DESCRIPTION

The tar and water condensed in the condenser 1 run via the duct 2 to the tar separator 3 and further over the duct 4 back to the condenser 1. The gas stream, on the other hand, exits the condenser 1 passing through the electrofilter 5 and entering the primary cooler 6. The outflow of the electrofilter 5 is directed via the duct 7 into the condenser circuit, for instance into the tar separator 3. In the primary cooler 6 a condensate is obtained which is practically free from fixed salts and is separately subjected to further treatment.

A part of the primary cooler condensate is returned via the duct 8 into the condenser circuit, for instance as shown here, into the condenser 1, since, besides the coal water, the water vapors, which have been vaporized before during the cooling of the hot crude gases in the condenser 1, are also condensed.

In the case of this operation mode, an enrichment of fixed salts in the condenser circuit occurs, which can lead to difficulties in the tar separation. Therefore, a quantity of fluid corresponding to the enrichment degree is continuously evacuated from the condenser circuit through the duct 9. This quantity is then compensated by the cooler condensate additionally returned through the duct 8.

The quantities of water evacuated through the duct 9 from the condenser circuit can be relieved from their volatile noxious substances in a still and also through the addition of lime, caustic soda or sodium carbonate can be relieved of the fixed ammonia and evacuated after dephenolization. Since only comparably small water amounts are involved, it is also possible to vaporize this solution, in order to obtain the fixed salts in solid state.

The condensate obtained in the primary coolers, after being used in the gas scrubbing, is relieved from its volatile noxious substances and, after a further biological cleaning, e.g. a reverse osmosis, after a dephenolization or a cleaning with active charcoal, can be used as service water in the coking plant, for instance for quenching of the coke or as cooling water.

Since in the process according to the invention naphthalene deposits in the primary coolers 6 can occur, in one of the embodiments of the invention a fractional condensation of the gases in several primary coolers is carried out. Thereby, in the first cooler, the gas is cooled only so far that the water quantities condensed (at approx. 70° C.) can be used as service water. During the cooling to the surrounding a second cooler is sprayed with tar or a mixture of tar, ammonia and water, in order to avoid deposits of naphthalene. The discharge of the second cooler is then returned through the duct 8 to the condenser circuit, for instance to the condenser 1.

The following table shows the effect of the electrofilter according to the invention on the composition of the gas between the condenser 1 and the primary coolers 6.

Composition of the crude gas without and after passing the electrofilter with the following technical data: Height: 6.5 m; diameter: 1.08 m; subdivision in 55 honeycombs; weight rate of gas flow: 1,000 $m^3$ i.N/h; direct voltage: 57 KV

| | | prior to (without) E-filter | after (with) E-filter |
|---|---|---|---|
| Gas temperature °C. | | 82 | 81 |
| tar over $C_{10}H_8$ | $g/m^3$ | 78.1 | 14.8 |
| $H_2O$ | $g/m^3$ | 811.0 | 765.0 |
| $NH_3$ | $g/m^3$ | 18.6 | 16.9 |
| $H_2S$ | $g/m^3$ | 13.8 | 13.7 |
| $^CC_6H_6$ | $g/m^3$ | 43.5 | 37.8 |
| Cl | $g/m^3$ | 1.6 | 0.06 |

I claim:

1. A process for the treatment of hot crude gas resulting from a coking operation, comprising the steps of:

(a) cooling said hot crude gas in a condenser to produce a tar-containing and a water-containing condensate and a gas phase;

(b) electrofiltering particulates from the gas phase produced in step (a) to produce a discharge and a filtered gas;

(c) subjecting said filtered gas to primary cooling to condense water therefrom in a salt-poor fraction of the total water contained in said hot crude gas and suitable for use as service water in a coking plant;

(d) combining said water-containing condensate from step (a) with said discharge from step (b) in a tar separator and recycling a tar and salt containing recycle from said tar separator to said condenser;

(e) withdrawing from said tar separator a salt-rich fraction of the total water contained in said hot crude gas for further treatment; and (f) feeding a quantity of said salt-poor fraction of the water from step (c) to said condenser to prevent buildup of deposits therein.

2. The process defined in claim 1 wherein the primary cooling in step (c) is carried out fractionally in a plurality of primary coolers.

* * * * *